US006936976B2

(12) United States Patent
Rudolph

(10) Patent No.: US 6,936,976 B2
(45) Date of Patent: Aug. 30, 2005

(54) CIRCUIT ARRANGEMENT AND METHOD FOR STARTING AND OPERATING GAS DISCHARGE LAMPS WITH HEATABLE ELECTRODE FILAMENTS

(75) Inventor: Bernd Rudolph, Forstern (DE)

(73) Assignee: Patent-Treuhand-Gesellschaft fur elektrische Gluhlampen mbH, Munich (DE)

( * ) Notice: Subject to any disclaimer, the term of this patent is extended or adjusted under 35 U.S.C. 154(b) by 5 days.

(21) Appl. No.: 10/762,253

(22) Filed: Jan. 23, 2004

(65) Prior Publication Data

US 2004/0150356 A1 Aug. 5, 2004

(30) Foreign Application Priority Data

Jan. 28, 2003 (DE) ..... 103 03 277

(51) Int. Cl.[7] ..... H05B 37/02

(52) U.S. Cl. ..... 315/224; 315/307; 315/DIG. 5; 315/DIG. 7

(58) Field of Search ..... 315/224, 307, 315/DIG. 5, DIG. 7

(56) References Cited

U.S. PATENT DOCUMENTS 5,939,836 A 8/1999 Mita et al. ..... 315/224
6,020,691 A * 2/2000 Sun et al. ..... 315/307
6,140,779 A 10/2000 Kanazawa et al. ..... 315/291
6,593,703 B2 * 7/2003 Sun ..... 315/224

FOREIGN PATENT DOCUMENTS

EP 0 845 928 6/1998
EP 0 930 808 7/1999

OTHER PUBLICATIONS

Jinrong Qian et al., "Analysis, Design, and Experiments of a High–Power–Factor Electronic Ballast", *IEEE Transactions on Industry Applications*, vol. 34, No. 3, May/Jun. 1998.

Jinrong Qian et al., "New Continuous–Input Current Charge Pump Power–Factor–Correction Electronic Ballast", *IEEE Transactions On Industry Applications, vol. 35, No. 2, Mar./Apr. 1999.*

* cited by examiner

*Primary Examiner*—David Vu

(57) ABSTRACT

Circuit arrangement for starting and operating discharge lamps (Lp1, Lp2) with control of the lamp current and preheating of electrode filaments. No control device is required for the sequence of the preheating, igniting and operating phases. This is achieved by a preheating resistor which changes its value after the preheating phase, in combination with controller properties according to the invention.

10 Claims, 1 Drawing Sheet

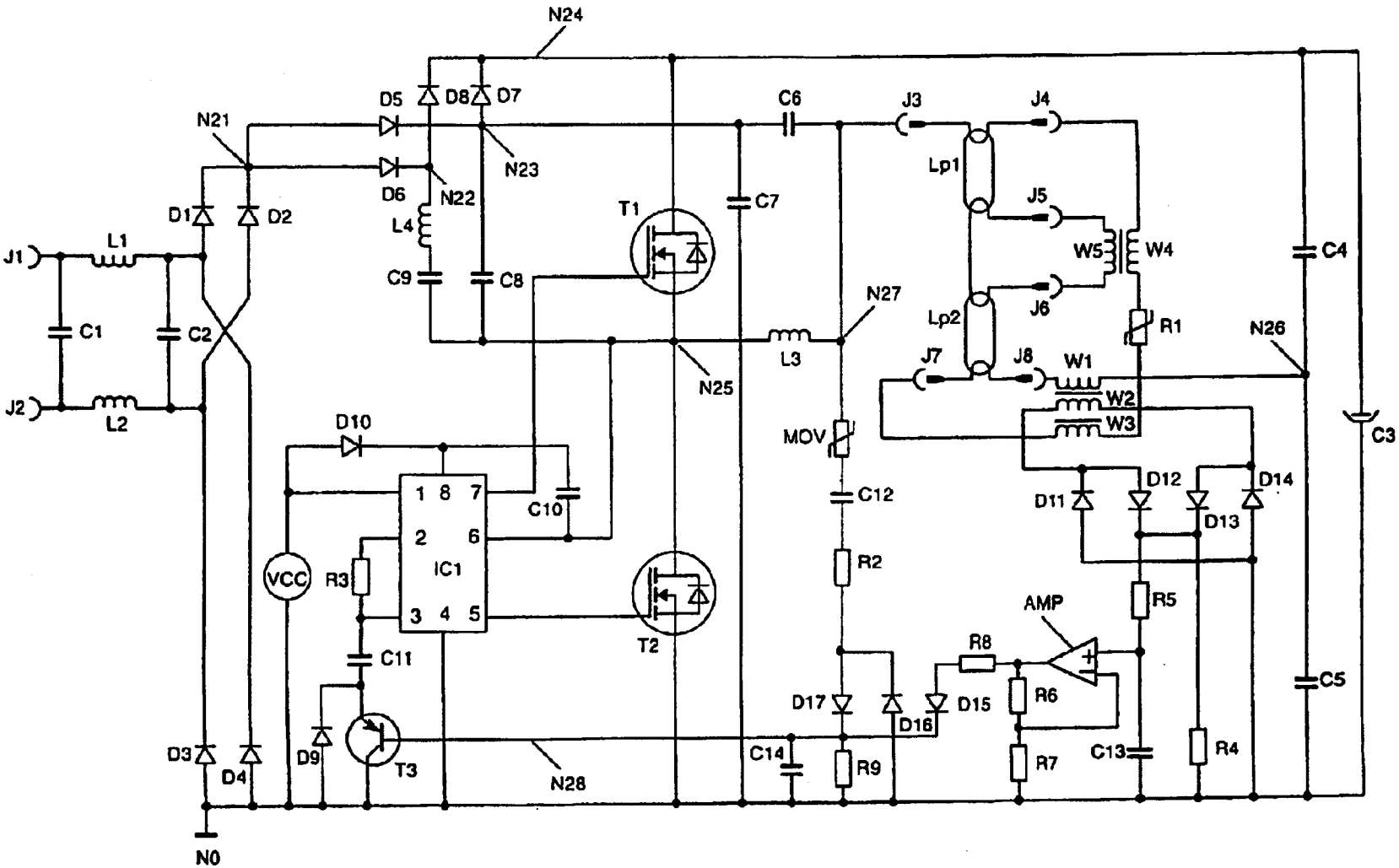
C3
C4
C5
N26
D14
D13
R4
D12
R5
R1
W4
W5
W2
W3
W1
C13
D11
AMP
R6
R7
J4
J5
J6
J8
Lp1
Lp2
J7
R8
D15
D16
J3
N27
C12
R2
R9
MOV
D17
C6
L3
C14
C7
N25
T1
T2
N24
C10
N28
D7
N23
C8
D8
N22
IC1
D5
D6
L4
C9
C11
T3
D10
R3
D9
VCC
D2
D4
N21
D1
C2
D3
N0
L1
L2
C1
J1
J2

CIRCUIT ARRANGEMENT AND METHOD FOR STARTING AND OPERATING GAS DISCHARGE LAMPS WITH HEATABLE ELECTRODE FILAMENTS

FIELD OF THE INVENTION

The invention relates to circuit arrangements and methods for starting and operating gas discharge lamps with heatable electrode filaments. It concerns in particular a circuit arrangement which performs a preheating of electrode filaments of discharge lamps before said lamps are ignited.

BACKGROUND OF THE INVENTION

Circuit arrangements for starting and operating discharge lamps are used in electronic operating devices for discharge lamps. The starting of the discharge lamps is understood hereafter as meaning a preheating of electrode filaments of the discharge lamps during a preheating phase and an ignition of the discharge lamps during an igniting phase. The starting of discharge lamps with a preheating phase and an igniting phase is also known in English as Program Start. The igniting phase follows an operating phase in which the discharge lamp has an arc discharge.

According to the prior art, an electronic operating device for discharge lamps with Program Start requires a circuit arrangement which comprises a control unit that controls the course and sequence of the preheating, igniting and operating phases.

Circuit arrangements with an inverter which feeds energy into one end, respectively, of the electrode filaments via a matching network are known. The other ends, respectively, are connected via a resonant capacitor. The resonant capacitor and a lamp inductor are part of a resonant circuit, which has a resonant frequency which in the undamped case lies at the natural frequency. The matching network is required to transform the source resistance of the inverter into a source resistance of the operating device that is suitable for the operation of discharge lamps. Said resonant circuit is generally a component part of the matching network.

The inverter generates at an inverter output an inverter voltage with an inverter frequency which in a preheating phase lies at a high preheating frequency that is greater than the natural frequency. The value of the resonant capacitor and of the preheating frequency are chosen in such a way as to produce a heating current through the electrode filaments that brings about adequate preheating for the respective type of lamp.

After the preheating phase, the inverter frequency is lowered in an igniting phase until it is close enough to the natural frequency to produce at a connected discharge lamp an ignition voltage that brings about an ignition of the discharge lamp.

The ignition of the discharge lamp is followed by an operating phase. In this phase, controlled variables, such as for example lamp power or lamp current, are fed to a controller. The controller uses a manipulated variable to act on the inverter frequency in such a way that a desired lamp power or a desired lamp current is produced.

The described prior art is described in various embodiments in the following documents:

EP 0 845 928 (Mita)

EP 0 930 808 (Kanazawa)

In the prior art, a control unit which sets the required inverter frequency in the correct time sequence in the respective phases is required. Moreover, the control unit must deactivate the control of the lamp power or lamp current during the preheating and igniting phases, since an inverter frequency which does not depend on the lamp power or lamp current is required in these phases.

With increasing cost pressure in respect of the operating devices for discharge lamps with which the invention is concerned, it is becoming increasingly important to dispense with parts of these operating devices.

SUMMARY OF THE INVENTION

The present invention makes it possible to dispense with the aforementioned control unit.

It is an object of the present invention to provide a low-cost circuit arrangement which accomplishes preheating, igniting and operating of discharge lamps. This object is achieved by a circuit arrangement with the following features:

An inverter, which delivers at an inverter output an inverter voltage which has an inverter frequency, discharge lamps with electrode filaments can be connected by means of lamp terminals to the inverter output via a matching network, which has a resonant circuit with a natural frequency, a preheating resistor, which brings about damping of the resonant circuit via the electrode filaments during a preheating phase, with the effect that the resonant frequency of the resonant circuit is reduced from the natural frequency to a damping resonant frequency, an igniting phase, in which the preheating resistor assumes values which bring about reduced damping of the resonant circuit in comparison with the preheating phase, with the effect that the resonant frequency of the resonant circuit approaches the natural frequency, a controller, the controller output of which outputs an actuating signal, the controller output being coupled to the inverter in such a way that the actuating signal influences the inverter frequency, a first controller input, into which there is fed a first electrical variable, which corresponds to the current of the gas discharge of a connected discharge lamp, the first electrical variable assuming a starting value in the event that there is no gas discharge, and the first electrical variable lying above a minimum value in the event that there is a gas discharge, in the event that the first electrical variable assumes the starting value, the controller brings about an inverter frequency which lies between the damping resonant frequency and the natural frequency and in the event that the first electrical variable lies above the minimum value, the controller brings about an inverter frequency which leads to a desired lamp current or a desired lamp power.

The object is essentially achieved by a circuit arrangement which accomplishes preheating, igniting and operating phases without requiring a control unit.

A circuit arrangement according to the invention has a preheating resistor, which brings about damping of the resonant circuit via the electrode filaments during a preheating phase, with the effect that the resonant frequency of the resonant circuit is reduced from the natural frequency to a damping resonant frequency. After the preheating phase, the preheating resistor assumes a value which is designed such that the resonant frequency of the resonant circuit lies close to the natural frequency.

A controller uses an actuating signal which influences the inverter frequency to control the lamp current or the lamp power. The term lamp current refers to the current which flows through the gas discharge of discharge lamps connected to lamp terminals.

A first electrical variable, which corresponds to the lamp current, is fed into a first controller input (B1), the first electrical variable assuming a starting value in the event that there is no gas discharge, and the first electrical variable lying above a minimum value in the event that there is a gas discharge.

According to the invention, the circuit arrangement is designed such that, in the event that the first electrical variable assumes the starting value, the controller sets the inverter to a starting frequency which lies between the damping resonant frequency and the natural frequency. The starting frequency is output until the first electrical variable lies below the minimum value. Accordingly, control does not take place in the case of values of the first electrical variable below the minimum value. In this state, the circuit arrangement is either in the preheating phase or the igniting phase. The type of phase is determined by the value of the preheating resistor.

If the value of the preheating resistor is low, a high heating current flows through the electrode filaments: the circuit arrangement is in the preheating phase. The resonant frequency of the resonant circuit is suppressed by the real part of the impedance of the electrode filaments and of the preheating resistor to the damping resonant frequency. According to the invention, the starting frequency lies above the damping resonant frequency. The offset between the starting frequency and the damping resonant frequency and also the damping of the resonant circuit have the effect that a voltage which is not adequate for ignition is present at connected discharge lamps.

If, after the preheating phase, the value of the preheating resistor increases, the resonant frequency of the resonant circuit increases and approaches the starting frequency which the inverter continues to output. At the same time, the damping of the resonant circuit is reduced. Both effects lead to a change of the circuit arrangement in the igniting phase. During the igniting phase, a voltage of a value high enough to ignite discharge lamps is present at the connected discharge lamps.

Consequently, a lamp current which according to the invention leads to a value for the first electrical variable that lies above the minimum value is produced. Consequently, the controller begins to operate; i.e. it sets an inverter frequency which brings about a desired lamp power or a desired lamp current. In this state, the circuit arrangement is in the operating phase.

The explained matching according to the invention of the damping resonant frequency, natural frequency, starting frequency, starting value, minimum value and preheating resistance means that there is no need for the aforementioned control unit which controls the sequence of the phases of the circuit arrangement.

BRIEF DESCRIPTION OF THE DRAWING

The invention is to be explained in more detail below on the basis of an exemplary embodiment with reference to a drawing.

The FIGURE shows an exemplary embodiment of a circuit arrangement according to the invention for starting and operating discharge lamps.

In the text which follows, resistors are denoted by the letter R, transistors by the letter T, coils by the letter L, amplifiers by the letter A, diodes by the letter D, node potentials by the letter N and capacitors by the letter C, in each case followed by a number.

DETAILED DESCRIPTION OF THE INVENTION

Represented in the FIGURE is an exemplary embodiment of a circuit arrangement according to the invention for starting and operating discharge lamps.

A line voltage can be connected to the terminals J1 and J2. In the present exemplary embodiment, the circuit arrangement is operated on a line voltage. However, the present invention is not restricted to operation on a line voltage. For example, a circuit arrangement according to the invention can also be operated on a battery voltage.

In the FIGURE, the line voltage is fed via a filter, comprising two capacitors C1, C2 and two coils L1, L2, to a full-bridge rectifier comprising the diodes D1, D2, D3, D4. The full-bridge rectifier provides the rectified line voltage at its positive output, a node N21, with respect to a reference node N0.

If the circuit arrangements in question are used in operating devices which are operated on a line voltage, they have to conform to relevant regulations with respect to line current harmonics, for example IEC 1000-3-2. To ensure compliance with these regulations, circuit measures are necessary for reducing line current harmonics. Such a measure is the installation of so-called charge pumps. The advantage of charge pumps is the low level of circuit complexity necessary to realize them.

The topology of a charge lamp comprises that the rectifier is coupled to the main energy store via an electronic pumping switch. As a result, a pumping node is produced between the rectifier and the electronic pumping switch. The pumping node is coupled to the inverter output via a pumping network. The pumping network may comprise components which can at the same time be assigned to the matching network. The principle of the charge pump is that, during a half-period of the inverter frequency, energy is drawn from the line voltage via the pumping node and buffer-stored in the pumping network. In the half-period of the inverter frequency which then follows, the buffer-stored energy is fed via the electronic pumping switch to the main energy store.

Accordingly, energy is drawn from the line voltage in time with the inverter frequency. The electronic operating device generally includes filter circuits, which suppress spectral components of the line current lying at or above the inverter frequency. The charge pump may be designed in such a way that the harmonics of the line current are low enough to comply with said regulations. The following documents provide a detailed description of charge pumps for electronic operating devices for discharge lamps:

Qian J., Lee F. C., Yamauchi, T.: "Analysis, Design and Experiments of a High-Power-Factor Electronic Ballast", IEEE Transactions on Industry Applications, Vol. 34, No. 3, May/June 1998

Qian J., Lee F. C., Yamauchi, T.: "New Continuous Current Charge Pump Power-Factor-Correction Electronic Ballast", IEEE Transactions on Industry Applications, Vol. 35, No. 2, March/April 1999.

Since both charge pumps and the present invention result in a lower level of circuit complexity, it is advantageous to combine the present invention with a charge pump.

In the FIGURE, the rectified line voltage is fed via the diodes D5 and D6 to two pumping nodes N22 and N23. The exemplary embodiment in the FIGURE accordingly has two so-called pumping branches. The diodes D5 and D6 are necessary for decoupling the pumping branches from each other. When there is only one pumping branch, a pumping node can be connected directly to the rectifier output, the node N21. In this case, however, it must be ensured that the diodes used in the rectifier can switch quickly enough to follow the inverter frequency. If this is not the case, a high-speed diode must be connected between the rectifier output and the pumping nodes even when there is only one pumping branch. In the exemplary embodiment in the FIGURE, the pumping nodes are coupled to the positive output of the rectifier. Charge pump topologies in which pumping nodes are coupled to the negative output of the rectifier are also known from the literature.

Leading from the pumping nodes N22 and N23 to the node N24 there is respectively an electronic pumping switch, configured as diodes D7 and D8. Connected between N24 and N0 is the main energy store, which is configured as electrolytic capacitor C3.

If the present invention is to be configured without a charge pump, the node N21 must be connected to the node N24. It is then possible to dispense with the components D5, D6, D7, D8, C8, C9 and L4.

C3 feeds the inverter, which is configured as a half bridge. Other converter topologies, such as for example a flyback converter or full bridge, can also be used, however. A half bridge is advantageously used for lamp powers of between 5 W and 300 W, since it represents the lowest-cost topology. The half bridge essentially comprises a series connection of two half-bridge transistors T1 and T2 and a series connection of two coupling capacitors C4 and C5. Both series connections are connected in parallel with C3. A connecting node N25 of the half-bridge transistors and a connecting node N26 of the coupling capacitors form the inverter output at which a square-wave inverter voltage with an inverter frequency is present.

Connected between N25 and a lamp voltage node N27 is a lamp inductor L3. Connected at N27 is the terminal J3, at which the series connection of two discharge lamps Lp1 and Lp2 is connected in the exemplary embodiment. However, the present invention can also be configured with one or more lamps. The current through the discharge lamps Lp1 and Lp2 flows via a terminal J8, through a winding W1 of a measuring transformer to the node N26. Consequently, the inverter voltage is essentially applied to a series connection of two discharge lamps Lp1, Lp2 and the lamp inductor L3.

The current fed into J3 flows not only through the gas discharge of the discharge lamps Lp1, Lp2 but also through an outer filament of the first discharge lamp Lp1 to a terminal J4. From there, it continues through a winding W4 of a heating transformer, on through a variable resistor R1 and on through a winding W3 of the measuring transformer to the terminal J7. Connected to the terminal J7 is an outer filament of the second discharge lamp Lp2, the other end of which leads to the terminal J8. Two inner filaments of the discharge lamps Lp1 and Lp2 are respectively connected via the terminals J5 and J6 to the winding W5 of the heating transformer. By the arrangement described in this paragraph, the inverter voltage brings about not only a current through the gas discharge of the discharge lamps Lp1, Lp2 but also a heating current through the outer filaments and, via the heating transformer, also a heating current through the inner filaments of the discharge lamps Lp1, Lp2. If only one discharge lamp is to be operated, it is possible to dispense with the heating transformer.

The heating current is essentially required before the ignition of the discharge lamps Lp1, Lp2, during a preheating phase as a preheating current for the preheating of the filaments. The value of the heating current is determined largely by the preheating resistor R1. During the preheating phase, the value of R1 is so low that a heating current prescribed by lamp data is achieved. After the preheating phase, the value of R1 increases, so that negligible heating current flows in comparison with the current through the gas discharge of the discharge lamps Lp1, Lp2. In the exemplary embodiment, R1 is realized by a so-called PTC or positive temperature coefficient thermistor. This is a resistor which in the cold state has a low resistance. The PTC thermistor is heated up by the heating current, making its resistance value increase. R1 may also be realized by an electronic switch which is closed in the preheating phase and then open. A resistor with a constant resistance value may be connected in series with the switch. Consequently, a rapid transition from the preheating phase to the igniting phase is possible.

The described arrangement for preheating the filaments has the effect that, during the preheating phase, the resonant frequency of a resonant circuit described in the next paragraph is lower than its natural frequency, due to damping. According to the invention, an inverter frequency which lies below the natural frequency is chosen during the preheating phase. Consequently, a high heating current, and consequently a short preheating phase, are advantageously obtained.

The lamp voltage node N27 is connected to the pumping node N23 via a first resonant capacitor C6. Connected between N23 and N0 is a second resonant capacitor C7. C6 and C7 form with the lamp inductor L3 a resonant circuit. For fixing the natural frequency of the resonant circuit, C6 and C7 are viewed as connected in series. The effective capacitance value of C6 and C7 with respect to the natural frequency is consequently the quotient of the product and the sum of the capacitance values of C6 and C7. If, after the preheating phase, the resonant circuit is stimulated close to its natural frequency, an ignition voltage that leads to the ignition of the discharge lamps is produced across the lamps. After the ignition, L3 acts together with C6 and C7 as a matching network, which transforms an output impedance of the inverter into an impedance necessary for the operation of the discharge lamps.

The connection of C6 and C7 to the pumping node N23 has the effect, however, that the combination of L3, C6 and C7 acts not only as a resonant circuit and matching network but at the same time as a pumping network. If the potential at N23 is lower than the momentary line voltage, the pumping network L3, C6, C7 draws energy from the line voltage. If the potential at N23 exceeds the voltage at the main energy store C3, the energy accepted from the line voltage is delivered at C3. The choice of the ratio of the capacitance values of C6 and C7 allows the effect of the network L3, C6, C7 as a pumping network to be adjusted. The greater the capacitance value of C7 is chosen to be, the less the network L3, C6, C7 acts as a pumping network. If the present invention is configured without a charge pump, it is possible to dispense with C7.

A further pumping effect is produced by a capacitor C8, which is connected between N23 and the connecting node N25 of the half-bridge transistors T1, T2. C8 also not only acts as a pumping network but at the same time performs the task of a snubber capacitor. Snubber capacitors are generally known as a measure for switch relief in inverters.

The pumping network for the second pumping branch comprises the series connection of a pumping inductor L4 and a pumping capacitor C9. This pumping network is connected between the connecting node N25 of the half-bridge transistors T1, T2 and the pumping node N22. In the case of the present exemplary embodiment, two pumping branches are used, in order that the pumped energy is divided between a number of components.

Lower-cost dimensioning of the components is consequently possible. It also provides a degree of freedom in the design of the dependence of the pumped energy on operating parameters of the discharge lamps. However, the invention can also be realized with only one pumping branch.

The half-bridge transistors T1, T2 are designed as MOSFETs. Other electronic switches may also be used for this. For activating the gates of T1 and T2, an integrated circuit IC1 is provided in the exemplary embodiment. IC1 is in the present example a circuit of the type IR2153 from the company International Rectifier. Alternative circuits of this type are also available on the market; for example L6571 from the company STM. The circuit IR2153 includes a so-called high-side driver, with which the half-bridge transistor T1 can also be activated, although it has no connection at the reference potential N0. A diode D10 and a capacitor C10 are necessary for this purpose.

The operating voltage supply of the IC1 takes place via the terminal 1 of the IC1. In the FIGURE, a voltage source VCC is provided for this purpose between terminal 1 of the IC1 and N0. Several possible ways in which this voltage source VCC can be realized are generally known. In the simplest case, the IC can be supplied via a resistor from the rectified line voltage.

Apart from the driver circuits for the half-bridge transistors, IC1 merely includes an oscillator, the oscillating frequency of which can be set via the terminals 2 and 3. On the basis of the present invention it is not necessary to increase the complexity of IC1 by incorporating a control device in it. Consequently, a low-cost type can be used for IC1. The oscillating frequency of said oscillator corresponds to the inverter frequency. Connected between the terminals 2 and 3 is a frequency-determining resistor R3. Connected between terminal 3 and N0 is the series connection of a frequency-determining capacitor C11 and the emitter-collector path of a bipolar transistor T3. Connected in parallel with the emitter-collector path of T3 is a diode D9, in order that C11 can be charged and discharged. The inverter frequency can be set by a voltage between the base terminal of T3 and N0 and consequently forms a manipulated variable for the control circuit. The base terminal of T3 is connected to a manipulated-variable node N28. T3, IC1 and their wiring can consequently be regarded as a controller.

The functions of the IC1 and its wiring can also be realized by any desired voltage-controlled or current-control oscillator which brings about the activation of the half-bridge transistors via driver circuits.

The control circuit in the exemplary embodiment records as a controlled variable the current through the gas discharge of the discharge lamps Lp1, Lp2. For this purpose, the measuring transformer has a winding W2. The winding direction in the measuring transformer is designed such that the heating current in the winding W3 is subtracted from an overall current in winding W1, so that in winding W2 there flows a current which is proportional to the current through the gas discharge of the discharge lamps Lp1, Lp2. A full-bridge rectifier, formed by diodes D11, D12, D13 and D14, rectifies the current through winding W2 and leads it via a low-resistance measuring resistor R4 to N0. The voltage drop across R4 is consequently a measure of the current through the gas discharge of the discharge lamps Lp1, Lp2. Passing via a low-pass filter for averaging, which is formed by a resistor R5 and a capacitor C13, the voltage drop across R4 reaches the input of a noninverting measuring amplifier.

The measuring amplifier is realized in a known way by an operational amplifier AMP and the resistors R6, R7 and R8. In the exemplary embodiment, a gain of the measuring amplifier of about 10 is set. In the event that the voltage drop across R4 has values which can be used directly as a manipulated variable, it is possible to dispense with the measuring amplifier or replace it with an impedance converter, such as for example an emitter follower.

The output of the measuring amplifier is connected via a diode D15 to the manipulated-variable node N28. Consequently, the control circuit for controlling the current through the gas discharge of the discharge lamps Lp1, Lp2 is closed. The diode D15 is necessary in order that the potential of N28 can be raised to a value that lies above the value prescribed by the measuring amplifier. The anode of D15 represents a first controller input.

According to the invention, the circuit arrangement is designed such that, without a lamp current, the potential of N28 assumes the starting value. The starting value is chosen such that it lies below a minimum value which limits the operating range of the transistor T3, and consequently of the controller. Fluctuations of the potential of N28 consequently have no influence on the inverter frequency as long as the potential of N28 lies below the minimum value. Control does not take place; the control circuit is not closed.

The starting value at the potential of the node N28 brings about an inverter frequency that corresponds to the starting frequency via T3 and IC1. A frequency that is as low as possible is chosen for the starting frequency, advantageously by means of C11 and R3, since high heating currents in the electrode filaments, and consequently short preheating phases, are consequently realized.

The igniting phase represents great loading for the half-bridge switches and for the components of the resonant circuit. In order to protect the circuit arrangement from overloading, a protective circuit is provided in the exemplary embodiment according to the FIGURE. If the igniting voltage is too high, the inverter frequency is raised as a result, and this produces a greater difference from the natural frequency of the resonant circuit.

The protective circuit only acts above an ignition voltage which is set by means of a threshold switch. The threshold switch is realized in the FIGURE by a varistor MOV. It lies in a series connection with a capacitor C12, a resistor R2 and a diode D17, which connects the voltage node N27 to the manipulated-variable node N28. The anode of D17 represents a second controller input. N28 is connected via the parallel connection of a resistor R9 and a capacitor C14 to N0.

At N27 there is with respect to N0 a voltage which is a measure of the reactive energy resonating in the resonant circuit, formed by L3, C6 and C7, and consequently of the ignition voltage. If this voltage exceeds the threshold voltage of the varistor MOV, a current flows through R9, and C14 is charged. The voltage at the manipulated-variable node N28 is consequently raised. This brings about an increase in the inverter frequency, and the reactive energy resonating in the resonant circuit is reduced, since the inverter frequency shifts further away from the natural frequency of the resonant circuit.

Connected between N0 and the connecting point of R2 and D17 is the diode D16. Consequently, acting together with C12, the sum of the positive amplitude and negative amplitude of the voltage which the varistor MOV allows to pass is applied to N28. Instead of the varistor MOV, any other desired threshold switch may be used, such as can be constructed for example by Zener diodes or suppressor diodes. The threshold value of the varistor MOV is chosen in the application example as 250 Vrms. A higher value has the effect that more reactive energy is allowed in the resonant circuit, which leads to a higher ignition voltage at the discharge lamps Lp1, Lp2, but also leads to a greater loading of components. Consequently, a desired optimum can be set by means of the threshold value of the varistor MOV.

The value of the resistor R2 influences the intensity of the effect of the intervention according to the invention on the control circuit at the manipulated-variable node N28. A nonlinear relationship between the voltage at the manipulated-variable node N28 and the inverter frequency is also advantageous. This nonlinear relationship is realized in the application example by the nonlinear characteristic of T3. Moreover, it is influenced by the dependence of the frequency of the oscillator in the IC1 on the voltage at the terminal 3 of the IC1. Due to the nonlinearity, a strong increase in the voltage at N27 leads to a disproportionate increase in the inverter frequency, whereby overloading of components, such as for example the voltage loading of C3 or the current loading of T1 and T2, is prevented.

After the ignition there flows a lamp current which raises the potential at the node 28 to a value that lies in the operating range of T3. Consequently, the control circuit for the lamp current is closed. T3 sets via IC1 an inverter frequency which brings about a desired lamp current.

What is claimed is:

1. A circuit arrangement for starting and operating discharge lamps (L, Lp1, Lp2), with the following features:

an inverter, which delivers at an inverter output (N25, N26) an inverter voltage which has an inverter frequency, discharge lamps (L, Lp1, Lp2) with electrode filaments can be connected by means of lamp terminals (J3–J6) to the inverter output (N25) via a matching network (L3, C6, C7), which has a resonant circuit (L3, C6, C7) with a natural frequency, a preheating resistor (R1), which brings about damping of the resonant circuit (L3, C6, C7) via the electrode filaments during a preheating phase, with the effect that the resonant frequency of the resonant circuit (L3, C6, C7) is reduced from the natural frequency to a damping resonant frequency, an igniting phase, in which the preheating resistor (R1) assumes values which bring about reduced damping of the resonant circuit (L3, C6, C7) in comparison with the preheating phase, with the effect that the resonant frequency of the resonant circuit (L3, C6, C7) approaches the natural frequency, a controller, the controller output of which outputs an actuating signal, the controller output being coupled to the inverter in such a way that the actuating signal influences the inverter frequency, a first controller input, into which there is fed a first electrical variable, which corresponds to the current of the gas discharge of a connected discharge lamp (Lp1, Lp2), the first electrical variable assuming a starting value in the event that there is no gas discharge, and the first electrical variable lying above a minimum value in the event that there is a gas discharge, in the event that the first electrical variable assumes the starting value, the controller brings about an inverter frequency which lies between the damping resonant frequency and the natural frequency and in the event that the first electrical variable lies above the minimum value, the controller brings about an inverter frequency which leads to a desired lamp current or a desired lamp power.

2. The circuit arrangement as claimed in claim 1, wherein the controller has a second controller input, into which there is fed via a threshold switch (MOV), a second electrical variable, which corresponds to a second operating variable, which is a measure of the reactive energy that resonates in the resonant circuit (L3, C6, C7), the value of the second electrical variable bringing about a greater value of the inverter frequency if the threshold value of the threshold switch (MOV) is exceeded.

3. The circuit arrangement as claimed in claim 1, wherein the inverter comprises a charge pump.

4. The circuit arrangement as claimed in claim 1, wherein the inverter is a half-bridge inverter.

5. The circuit arrangement as claimed in claim 1, wherein the preheating resistor (R1) is a temperature-dependent resistor with a positive temperature coefficient.

6. The circuit arrangement as claimed in claim 1, characterized in that the preheating resistor (R1) is connected in series with an electronic switch.

7. A method for starting and operating discharge lamps with a circuit arrangement as claimed in claim 1, characterized by the following steps:

damping the resonant circuit (L3, C6, C7) by a preheating resistor (R1) via electrode filaments of connected discharge lamps, removal of the damping of the resonant circuit (L3, C6, C7).

8. The circuit arrangement as claimed in claim 2, characterized in that the preheating resistor (R1) is connected in series with an electronic switch.

9. The circuit arrangement as claimed in claim 3, characterized in that the preheating resistor (R1) is connected in series with an electronic switch.

10. The circuit arrangement as claimed in claim 4, characterized in that the preheating resistor (R1) is connected in series with an electronic switch.

* * * * *